United States Patent [19]

Campbell et al.

[11] Patent Number: 4,986,583

[45] Date of Patent: Jan. 22, 1991

[54] DOOR-LATCH OPENER

[75] Inventors: Andrew B. Campbell, San Mariano; Ira J. Simon, Long Beach, both of Calif.

[73] Assignee: Triangle Brass Manufacturing Company, Los Angeles, Calif.

[21] Appl. No.: 529,717

[22] Filed: May 30, 1990

Related U.S. Application Data

[63] Continuation of Ser. No. 249,448, Sep. 26, 1988, abandoned.

[51] Int. Cl.[5] ..... E05B 3/00

[52] U.S. Cl. ..... 292/336.3; 292/165; 292/DIG. 65; 292/DIG. 66

[58] Field of Search ..... 292/165, 336.3, DIG. 65, 292/DIG. 66

[56] References Cited

U.S. PATENT DOCUMENTS

| | | | |
|---|---|---|---|
| 3,441,269 | 4/1969 | Doyle | 292/165 |
| 3,477,754 | 11/1969 | Check | 292/165 |
| 3,705,739 | 12/1972 | Adler | 292/92 |
| 3,722,938 | 3/1973 | Bauer | 292/92 |
| 3,897,092 | 7/1975 | Atkins | 292/92 |
| 3,975,933 | 8/1976 | Bako | 70/79 |
| 4,003,593 | 1/1977 | Wilzig | 292/92 |
| 4,007,954 | 2/1977 | Erickson | 292/165 |
| 4,145,900 | 3/1979 | Ohno | 70/92 |
| 4,384,738 | 5/1983 | Floyd | 292/92 |
| 4,629,228 | 12/1986 | Marko et al. | 292/165 |

*Primary Examiner*—Eric K. Nicholson
*Assistant Examiner*—Michael J. Milano
*Attorney, Agent, or Firm*—Lyon & Lyon

[57] ABSTRACT

A push-type and a pull-type door-latch opener capable of use with a plunger-type fusible pin operated fire-safety lock mechanism including a mounting plate, a horizontal pivoting rod attached to the plate, a vertical pivoting rod attached to the plate at a right angle to and adjacent the horizontal pivoting rod, a horizontal bell crank pivoted about the vertical rod and having a first arm projecting into the plane of the door for operating the door-latch and a second arm engaged by a portion of a door handle pivoted on the horizontal rod, and a torsion spring coaxial with the horizontal rod for biasing the door handle into a preselected position.

6 Claims, 3 Drawing Sheets

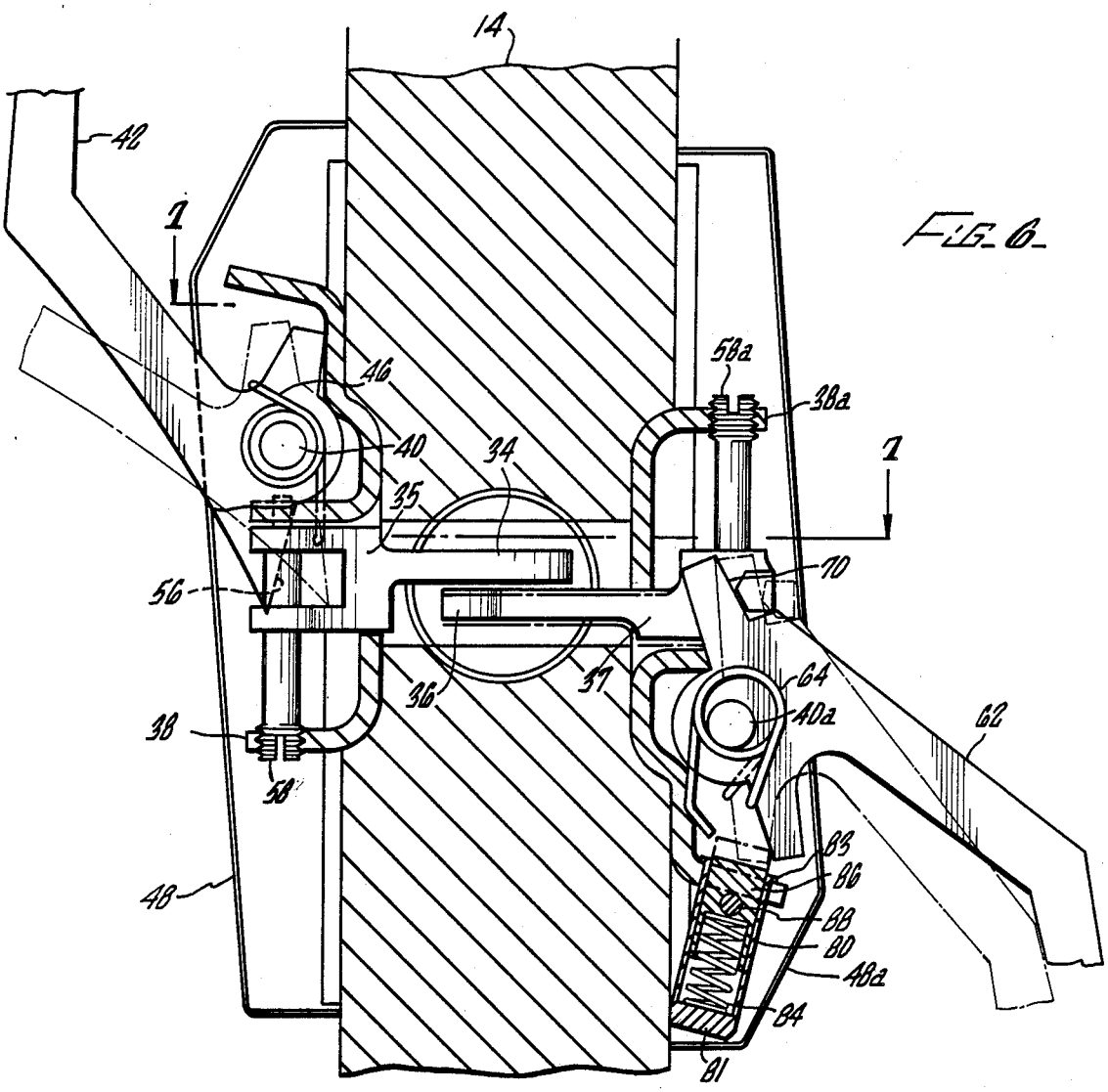
FIG. 6
FIG. 7
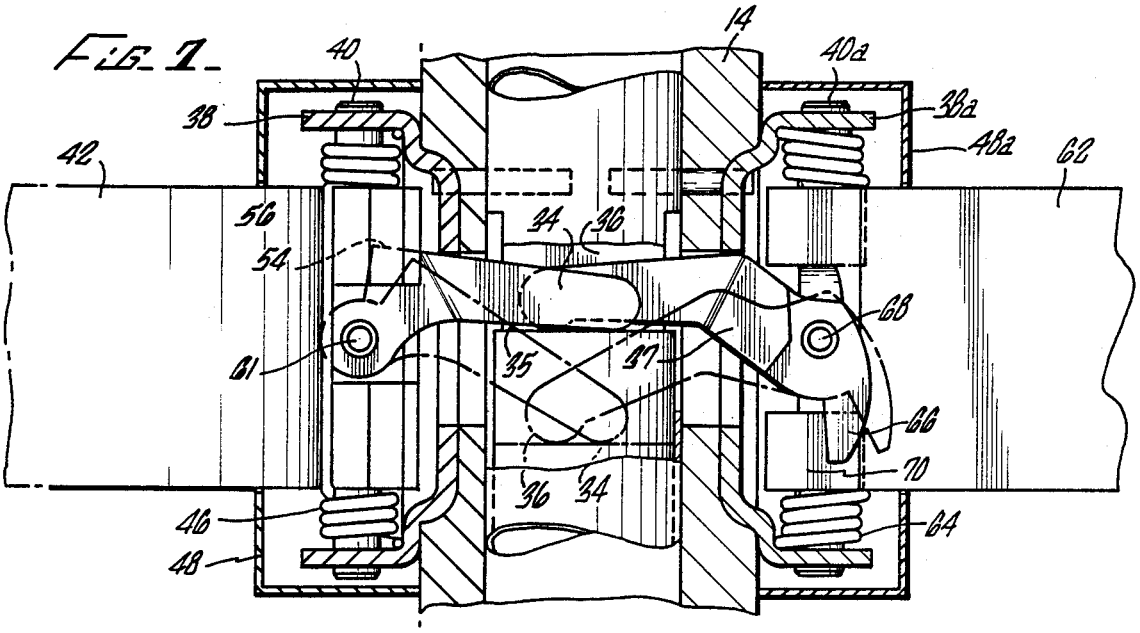

DOOR-LATCH OPENER

This application is a continuation of application Ser. No. 249,448, filed Sept. 26, 1988, now abandoned.

BACKGROUND OF THE INVENTION

1. Field of the Invention

This invention relates to the field of door-latch openers, particularly door-latch openers of the type used in hospitals and similar facilities having push and/or pull-type actuation. More particularly this invention relates to push and pull-type actuated door-latch openers having fire safety locks.

2. Description of Related Art

Push-type door-latch openers and pull-type door-latch openers are now in common use in hospitals and other facilities where normal rotationally activated door-latch openers are undesirable for one reason or another. In typical application a pull-type door-latch opener will be mounted on the side of a door toward which the door opens and a push-type door-latch opener will be mounted on the opposite side thereof. In this manner, one motion control of the door is achieved.

Door-latch openers according to the present invention operate a door-latch mechanism which comprises a door bolt biased into the latched position by a spring. The door may be unlatched so that it may be opened by moving the latch back into the door against the bias. This function is performed by a door-latch opener. The door-latch opener operates a lever arm which moves the latch back into the door allowing the door to be opened.

Push-type door-latch openers are typically used in doors along corridors in hospitals where doors open into rooms from the corridor. Door-latches used in these environments should have the feature of being push-operated from the corridor and pull-operated from the room. Door-latches used in these environments are typically required to have a fire override feature or fire-safety lock which inhibits push-operation from the corridor under fire conditions. The fire-safety lock should, for example, prevent the blast of water from a fire hose operated in the corridor from activating the push-latch and opening the door.

Push-type door-latch openers of the prior art are described, for example, in U.S. Pat. No. 4,003,593. Although fit for their intended purposes, such door-latch openers have sometimes proven difficult to install in all of their various configurations, lack adequate biasing of the door handle under certain circumstances and the pull and push versions of the door-latch openers have had less than an optimal number of common parts.

SUMMARY OF THE INVENTION

The door-latch openers of the present invention include a mounting means for attaching the door-latch opener to a door; horizontal pivoting means attached to said mounting means; vertical pivoting means attached to said mounting means and positioned at a right angle to and adjacent said horizontal pivoting means; a horizontal bell crank pivoted about said vertical pivoting means, said horizontal bell crank having a first arm projecting into the plane of the door and a second arm adapted to be engaged by a door handle; said door handle pivoted about said horizontal pivoting means and biased to a preselected position by a biasing means mounted coaxial with said horizontal pivoting means.

In a preferred embodiment, a push-type or push-operated door-latch opener includes a door handle biased to a first "out" position and adapted to be pushed to a second "in" position, the door handle having a portion which engages the second arm of the horizontal bell crank so that pushing the door handle causes the portion of the door handle to push the second arm of the horizontal bell crank away from the plane of the door and simultaneously turn the first arm of the horizontal bell crank, thereby operating the door's latching mechanism.

In another preferred embodiment, a pull-type or pull-operated door-latch opener includes a door handle biased to a first in position and adapted to be pulled to a second out position, the door handle having a portion which engages the second arm of the horizontal bell crank so that pulling the door handle causes the portion of the door handle to push the second arm of the horizontal bell crank toward the plane of the door and simultaneously turn the first arm of the horizontal bell crank, thereby operating the door's latching mechanism.

In another preferred embodiment, the mounting means is manufactured of stamped metal and a cartridge-type fire stop feature is included with the push activated latch control which may be simply inserted through a hole in the stamped base plate to provide an override to operation of the latch in the presence of a fire.

It is an object of this invention to provide a novel push-type door-latch opener.

It is another object of this invention to provide a novel pull-type door-latch opener.

It is a further object of this invention to provide push-type and pull-type door-latch openers having improved biasing of the door handles.

It is yet another object of this invention to provide push-type and pull-type door-latch openers having an improved fire-safety lock feature.

Other and further objects and advantages will appear hereinafter.

BRIEF DESCRIPTION OF THE DRAWINGS

FIG. 6 is a cross sectional view showing a pair of door-latch openers according to the present invention mounted on a door. At the left is a pull-type door-latch opener in a handle pointed up orientation and at the right is a push-type door-la opener in a handle pointed down orientation.

FIG. 7 is a cross sectional view taken along lines 7—7 of FIG. 6.

DESCRIPTION OF THE PREFERRED EMBODIMENT

Figure 1:
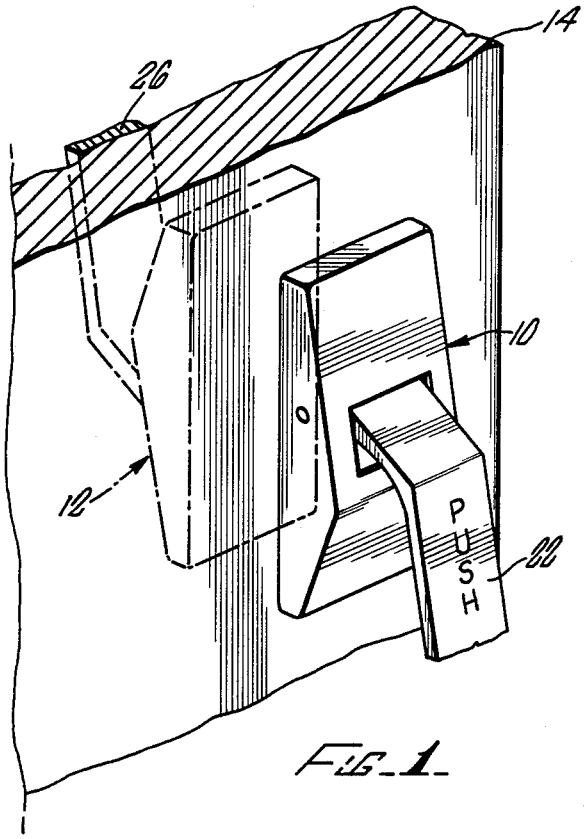
FIG. 1 is a perspective view of a push-type door-latch opener in a handle pointed down orientation according to the present invention mounted on the corridor side of a door (right side of figure) and a pull-type door-latch opener in a handle pointed up orientation according to the present invention mounted on the room side of a door (left side of figure).
Figure 2:
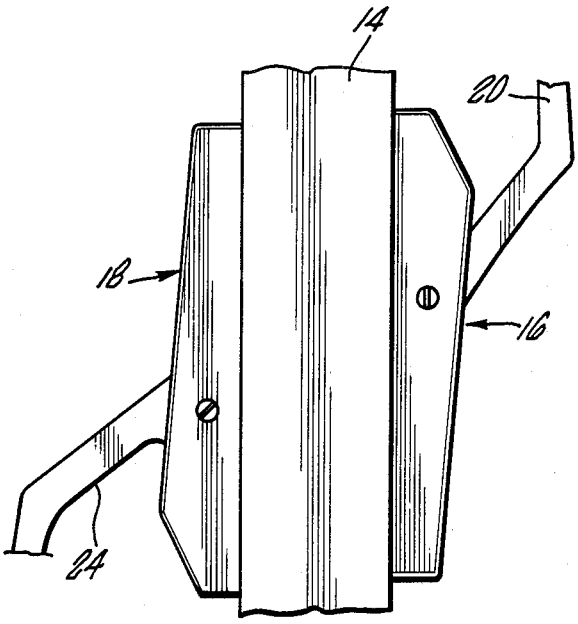
FIG. 2 is a side elevation of a push-type door-latch opener in a handle pointed up orientation according to the present invention mounted on the corridor side of a door (right side of figure) and a pull-type door-latch opener in a handle pointed down orientation according to the present invention mounted on the room side of a door (left side of figure).
Figure 3:
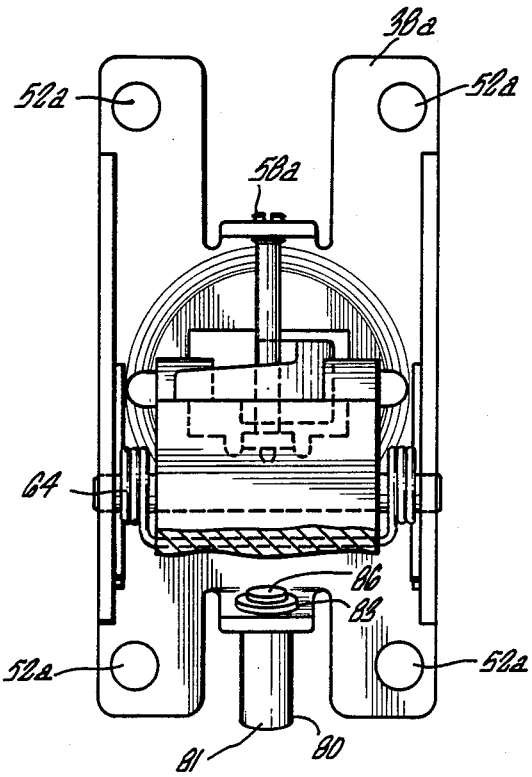
FIG. 3 is a cross sectional view of a push-type door-latch opener according to the present invention oriented as it would be for handle pointed down operation.
Figure 4:
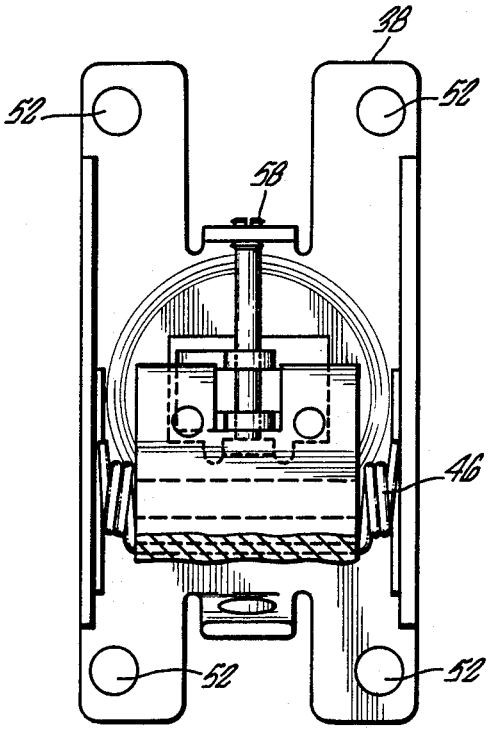
FIG. 4 is a cross sectional view of a pull-type door-latch opener according to the present invention oriented as it would be for handle pointed down operation.

Novel push-type and pull-type door-latch openers are disclosed. Turning now to the drawings, FIG. 1 shows a push-type door-latch opener !0 and a pull-type door-latch opener 12 mounted on a door 14. Typically push-type door-latch openers are mounted along a corridor so that a door handle may be pushed, activating the latch mechanism and causing the door to open into a room. Pull-type door-latch openers are accordingly typically mounted inside rooms so that the doors to which they are attached may be opened inward by pulling. FIG. 2 shows a slightly different configuration with a push-type door-latch opener 16 and a pull-type door-latch opener 18. As can be seen, the door-latch openers according to the present invention may be configured with their handles pointed either up or down. Push-type door-latch opener 16 has its handle 20 in an upward pointing orientation while push-type door-latch opener 10 in FIG. 1 has its handle 22 in a downward pointing orientation. Similarly pull-type door-latch opener 18 of FIG. 2 has its handle 24 in a downward pointing orientation while pull-type door-latch opener 12 of FIG. 1 has its handle 26 in an upward pointing orientation.

Figure 5:
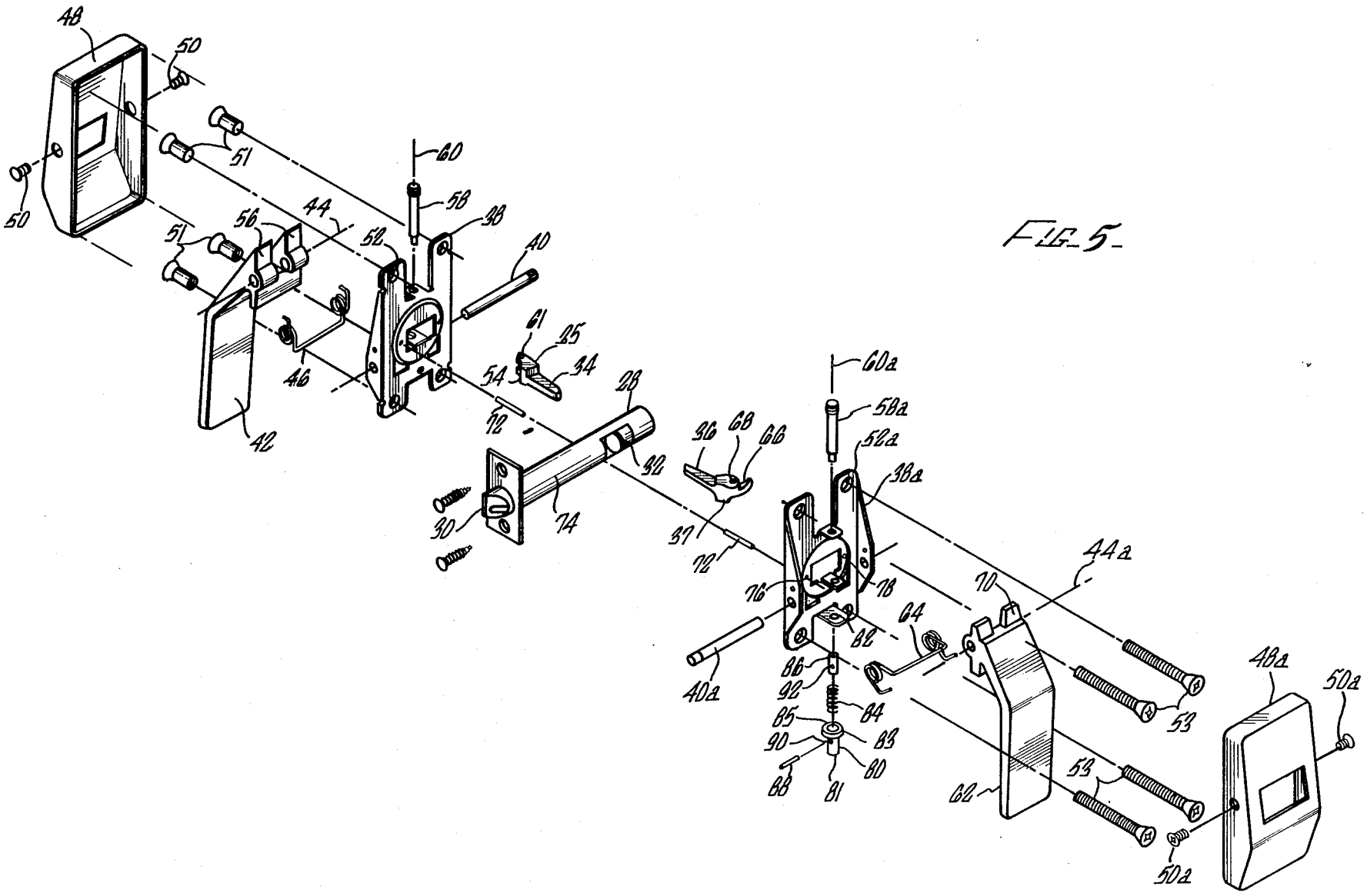
FIG. 5 is an exploded view showing a pull-type door-latch opener in a handle pointed down orientation according to the present invention at the left, a typical door-latch mechanism at the center, and a push-type door-latch opener in a handle pointed down orientation according to the present at the right.

Turning now to FIG. 5, an exploded view of a pull-type door-latch opener according to the present invention is shown at the left, a typical door-latch mechanism well known in the art is shown at the center, and a push-type door-latch opener according to the present invention is shown at the right. FIGS. 3, 4, 6 and 7 provide detailed views of various aspects of the invention. Door-latch mechanism 28 is a typical door-latch mechanism as is well known in the art. Latch 30 is withdrawn by compressing actuator 32 against a biasing means contained in door latch mechanism 28. This is accomplished in the case of the pull-type door-latch opener by moving the first arm 34 of pull-type horizontal bell crank 35 against actuator 32 and in the case of the push-type door-latch opener by moving the first arm 36 of push-type horizontal bell crank 37 against actuator 32.

Operation and construction of the pull-type door-latch opener is now described. The pull-type door-latch opener is constructed on a base plate 38 which is preferably made of stamped steel. Base plate 38 provides a mounting means for mounting the door-latch opener to door 14. Hardware 51 and 53 is used in the conventional manner to mount the door-latch openers to door 14 through hole 52 in base plate 38 in a conventional manner. To base plate 38 is attached lever pin 40. Pull-type door handle 42 is mounted to lever pin 40 about axis 44 and may rotate about lever pin 40. Pull-type spring 46 is a torsion spring and provides a means for biasing pull-type door handle 42 to a predetermined first "in" position. Spring 46 is fabricated to mount coaxially on lever pin 40 about axis 44. Cover 48 is provided and mounts to base plate 38 in a conventional manner with hardware 50. Pull-type horizontal bell crank 35 has a first arm 34 and second arm 54. Crank 35 also has a pivot hole 61 and is adapted to be mounted on and pivot about vertical pin 58. Second arm 54 is engaged by one of the extended portions 56 of pull-type door handle 42 so that when pull-type door handle 42 is pulled to a second "out" position, portion 56 will pivot about axis 44 toward the plane of the door pushing against second arm 54 and causing horizontal bell crank 35 to pivot about vertical pin 58 on axis 60. In this manner, first arm 34 will operate door-latch mechanism 28.

Operation and construction of the push-type door-latch opener is now described. Similarly to the pull-type door-latch opener, in a preferred embodiment of the invention the push-type door-latch opener of the preferred embodiment is constructed on a base plate 38*a* identical to that of the pull-type door-latch opener. Base plate 38*a* is also preferably made of stamped steel. To base plate 38*a* is attached lever pin 40*a*. Push-type door handle 62 is mounted to lever pin 40*a* about axis 44*a* and may rotate about lever pin 40*a*. Push-type spring 64 provides a means for biasing push-type door handle to a predetermined first "out" position. Spring 64 is fabricated to mount coaxial with lever pin 40*a* on axis 44*a*. Cover 48*a* is provided and mounts to base plate 38*a* in a conventional manner with hardware 50*a*.

Push-type horizontal bell crank 37 has a first arm 36 and a second arm 66. It also has a pivot hole 68 and is adapted to be mounted on and pivot about vertical pin 58*a*. Second arm 66 is engaged by one of the extended portions 70 of push-type door handle 62 so that when push-type door handle 62 is pushed to a second "in" position, portion 70 will pivot about axis 44*a* away from the plane of the door pushing against second arm 66 and causing push-type horizontal bell crank 37 to pivot about vertical pin 58*a* on axis 60*a*. In this manner, first arm 36 will operate door-latch mechanism 28.

In a preferred embodiment of the present invention, the push-type door-latch opener may be mounted on the right hand side or the left hand side of a door. As shown in FIG. 5, the push-type door-latch opener is shown as it would be configured for use on the left hand side of a door. To adapt it to right hand side operation, registration pin 72 which engages door latch mechanism 28 at registration hole 74 must be moved from mounting hole 76 in base plate 38*a* to mounting hole 78 in the base plate 38*a*. Likewise, horizontal bell crank 37 must be inverted. A similar arrangement as will appear clear to those of skill in the art is provided for the pull-type door-latch opener to provide for right-left interchange and will therefore not be described further.

In a preferred embodiment of the present invention, the pull-type door-latch opener and the push-type door-latch opener are manufactured so that they may be mounted in a handle-up or handle-down configuration simply by attaching base plate 38, 38*a* to the door 14 as desired and adjusting the right/left handedness of the door-latch opener as described above.

In a preferred embodiment of the present invention, an improved fire-safety lock feature is provided for push-type door-latch openers (and it could also be provided for pull-type door latch openers as would be clear to those of skill in the art). Canister 80 which is enclosed at its bottom end 81 is mounted in retainer hole 82 of base plate 38*a* by means of retainer flange 83. Spring 84 fits inside aperture 85 in canister 80 and plunger 86 fits on top of spring 84 within canister 80. Spring 84 biases plunger 86 to exit canister 80 but a fire sensing material 88 in the shape of a wire having a predetermined melting point, which in a preferred embodiment is approximately 450 degrees fahrenheit, is interposed through hole 90 in canister 80 and hole 92 in plunger 86 so as to restrain the ejection of plunger 86 from canister 80 until the fire sensing material 88 melts. Upon the melting of fire sensing material 88, plunger 86 is ejected by the force of spring 84 into the path of door handle 62 as shown in FIG. 6. In this manner, door handle 62 is prevented from operating the door-latch opener. A similar feature could be provided if desired, in a pull-type door-latch opener.

While embodiments and applications of this invention have been shown and described, it would be apparent to those of skill in the art that many more modifications are possible without departing from the invention concepts herein. The invention, therefore, is not to be restricted except in the spirit of the appended claims.

What is claimed is:

1. A door comprising:

(1) A linearly actuated tubular door-latch;

(2) A push-type door-latch opener adapted to be mounted to the door for operating said door-latch comprising:

first mounting means for mounting said push-type door-latch opener to the door;

said first mounting means comprising a first base plate fabricated of stamped metal;

first horizontal pivoting means attached to said first mounting means;

first vertical pivoting means attached to said first mounting means and positioned at substantially a right angle to and adjacent to said first horizontal pivoting means;

a first horizontal bell crank pivoted about said first vertical pivoting means;

said first horizontal bell crank having a first arm projecting into the plane of the door and a second arm adapted to be contacted by a push-type door handle;

said push-type door handle pivoted about said first horizontal pivoting means;

said push-type door handle adapted to have a first out position and a second in position;

first biasing means biasing said push-type door handle to said first out position, said first biasing means mounted coaxial with said first horizontal pivoting means;

said push-type door handle having a first portion adapted to engage said second arm;

said push-type door handle adapted to be mounted with the handle pointed along the vertical length of the door;

said first base plate having a retainer hole therethrough:

a hollow canister mounted through said retainer hole having a closed end, an open end, a retainer flange, an axis defined by the center of said open end and the center of said closed end, and a first hole through said hollow canister along a line normal to said axis;

a plunger having a second hole therethrough slidably mounted within said hollow canister;

said plunger having a retracted position and a protracted position; said push-type door handle prevented from attaining said second in position when said plunger is in said protracted position;

plunger biasing means biasing said plunger toward said protracted position;

a fire sensing material means having a predetermined melting point passing through said first hole and said second hole and retaining said plunger in aid retracted position against a plunger bias imparted by said plunger biasing means;

said plunger capable of movement from said retracted position along said axis and away from said closed end to said protected position upon melting of said fire sensing material means;

said hollow canister prevented from escape from said retainer hole by said retainer flange and said fire sensing material means; and (3) A pull-type door-latch opener adapted to be mounted to the door for operating said door-latch comprising:

second mounting means for mounting said pull-type door-latch opener to the door;

said second mounting means comprising a second base plate fabricated of stamped metal;

second horizontal pivoting means attached to said second mounting means;

second vertical pivoting means attached to said second mounting means and positioned at substantially a right angle to and adjacent to said second horizontal pivoting means;

a second horizontal bell crank pivoted about said second vertical pivoting means;

said second horizontal bell crank having a third arm projecting into the plane of the door and a fourth arm adapted to be contacted by a pull-type door handle;

said pull-type door handle pivoted about said second horizontal pivoting means;

said pull-type door handle adapted to have a first in position and a second out position;

said pull-type door handle adapted to be mounted with the handle pointed along the length of the door;

second biasing means biasing said pull-type door handle to said first in position, said second biasing means mounted coaxial with said second horizontal pivoting means;

said pull-type door handle having a second portion adapted to engage said fourth arm.

2. A push-type door-latch opener for operating a door-latch mounted in a door comprising:

a mounting means for mounting the push-type door-latch opener to the door;

said mounting means including a base plate having a retainer hole therethrough;

pivoting means attached to said mounting means;

a push-type door handle pivoted about said pivoting means;

a hollow canister having a first closed end, a second open end, a retainer flange, a first axis defined by the center of said first closed end and said second open end, and a first hole passing through said hollow canister in a line normal to said first axis;

a biasing spring and a plunger located within said hollow canister;

said biasing spring intermediate said first closed end and said plunger and applying a bias between said first closed end and said plunger;

said plunger having a second axis coincident with said first axis and a second hole through said plunger normal to said second axis;

a fire sensing material means having a predetermined melting point passing through said first hole and said second hole;

said hollow canister mounted through said retainer hole and restrained from removal therefrom, prior to exposure to temperatures in excess of said predetermined temperature, by said retainer flange and said fire sensing material means;

said plunger capable of movement along said first axis and away from said first closed end upon exposure to temperatures in excess of said predetermined temperature so as to interfere with the movement of said push-type door-latch opener and thereby prevent the push-type door latch opener from opening the door latch.

3. A push-type door-latch opener for operating a door-latch mounted in a door comprising:

a mounting means for mounting the push-type door-latch opener to the door;

said mounting means including a base plate having a retainer hole therethrough;

a door handle for operating the door latch;

a hollow canister mounted through said retainer hole having a closed end, an open end, a retainer flange, a first axis defined by the center of said closed end and the center of said open end, and a first hole passing through said hollow canister in a line normal to said first axis;

a biasing means and a plunger located within said hollow canister;

said plunger having a retracted position and a protracted position;

operation of the door latch by said door handle permitted when said plunger is in said retracted position and operation of the door latch by said door handle prevented by interference between said plunger and said door handle when said plunger is in said protracted position;

said biasing means biasing said plunger along said first axis, away from said closed end and toward said protracted position;

said plunger having a second hole therethrough;

a fire sensing material means having a predetermined melting point passing through said first hole and said second hole and restraining said plunger in said retracted position against a bias imparted by said biasing means;

said plunger capable of movement from said retracted position along said first axis and away from said closed end to said protracted position upon melting of said fire sensing material means;

said hollow canister prevented from escape from said retainer hole by said retainer flange and said fire sensing material means prior to exposure to temperatures in excess of said predetermined melting point.

4. A fire lock for a door-latch opener having a door handle and a base plate for operating a door-latch mounted in a door, the fire lock having a plunger having a disengaged position and an engaged position, the disengaged position permitting operation of the door latch by the door handle and the engaged position preventing operation of the door latch by the door handle, comprising:

a hollow canister having a closed end, an open end, a retainer flange, and a first hole passing through said hollow canister;

the plunger located within said hollow canister, having a second hole therethrough, biased toward the engaged position by a biasing means, and restrained in the disengaged position by a fire sensing material means having a predetermined melting point and passing through said first hole and said second hole;

said hollow canister mounted through a retainer hole in the base plate and held in place by said retainer flange and said fire sensing material means;

the plunger capable of travel from the disengaged position to the engaged position upon the melting of said fire sensing material means.

5. A push-type door-latch opener for mounting on the right or left side of a door for operating a linearly actuated tubular door latch mounted in the door comprising:

mounting means for mounting the push-type door-latch opener to the door;

said mounting means including a base plate;

said base plate including horizontal pivoting means and vertical pivoting means removably mounted at substantially a right angle to and adjacent said horizontal pivoting means and substantially parallel to the plane of the door;

a push-type horizontal bell crank removably and reversibly pivoted about said vertical pivoting means;

said push-type horizontal bell crank having a first arm projecting into the plane of the door and a second arm adapted to be engaged by a door handle;

said door handle pivoted about said horizontal pivoting means;

said door handle adapted to have a first out position and a second in position;

biasing means coaxial with said horizontal pivoting means biasing said door handle to said first out position;

said door handle having a portion adapted to engage said second arm;

a retainer hole extending through said base plate;

a hollow canister mounted through said retainer hole having a closed end, an open end, a retainer flange, an axis defined by the center of said open end and the center of said closed end, and a first hole through said hollow canister along a line normal to said axis;

a plunger having a second hole therethrough slidably mounted within said hollow canister;

said plunger having a retracted position and a protracted position; said push-type door handle prevented from attaining said second in position when said plunger is in said protracted position;

plunger biasing means biasing said plunger toward said protracted position;

a fire sensing material means having a predetermined melting point passing through said first hole and said second hole and retaining said plunger in said retracted position against a plunger bias imparted by said plunger biasing means;

said plunger capable of movement from said retracted position along said axis and away from said closed end to said protracted position upon melting of said fire sensing material means; and said hollow canister prevented from escape from said retainer hole by said retainer flange and said fire sensing material means.

6. A pull-type door-latch opener for mounting on the right or left side of a door for operating a linearly actuated tubular door latch mounted in the door comprising:

mounting means for mounting the pull-type door latch opener to the door;

said mounting means including a base plate;

said base plate including horizontal pivoting means and vertical pivoting means removably mounted at substantially a right angle to and adjacent said horizontal pivoting means and substantially parallel to the plane of the door;

a pull-type horizontal bell crank removably and reversibly pivoted about said vertical pivoting means;

said pull-type horizontal bell crank having a first arm projecting into the plane of the door and a second arm adapted to be engaged by a door handle;

said door handle pivoted about said horizontal pivoting means;

said door handle adapted to have a first in position and a second out position;

biasing means coaxial with said horizontal pivoting means biasing said door handle to said first in position;

said door handle having a portion adapted to engage said second arm;

a retainer hole extending through said base plate;

a hollow canister mounted through said retainer hole having a closed end, an open end, a retainer flange, an axis defined by the center of said open end and the center of said closed end, and a first hole through said hollow canister along a line normal to said axis;

a plunger having a second hole therethrough slidably mounted within said hollow canister;

said plunger having a retracted position and a protracted position; said push-type door handle prevented from attaining said second in position when said plunger is in said protracted position;

plunger biasing means biasing said plunger toward said protracted position;

a fire sensing material means having a predetermined melting point passing through said first hole and said second hole and retaining said plunger in said retracted position against a plunger bias imparted by said plunger biasing means;

said plunger capable of movement from said retracted position along said axis and away from said closed end to said protracted position upon melting of said fire sensing material means; and said hollow canister prevented from escape from said retainer hole by said retainer flange and said fire sensing material means.

* * * * *

UNITED STATES PATENT AND TRADEMARK OFFICE

CERTIFICATE OF CORRECTION

PATENT NO. : 4,986,583

DATED : January 22, 1991

INVENTOR(S) : Campbell et al.

It is certified that error appears in the above-identified patent and that said Letters Patent is hereby corrected as shown below:

In column 3, line 7, delete "door-la" and insert therefor -- door-latch --.

In column 6, line 6, delete "aid" and insert therefor -- said --.

Signed and Sealed this

Thirteenth Day of October, 1992

*Attest:*

DOUGLAS B. COMER

*Attesting Officer*

*Acting Commissioner of Patents and Trademarks*